United States Patent [19]

Selame

[11] Patent Number: 5,037,000

[45] Date of Patent: Aug. 6, 1991

[54] RUBBER BAND DISPENSER

[75] Inventor: Robert Selame, Brookline, Mass.

[73] Assignee: Plymouth Rubber Company, Canton, Mass.

[21] Appl. No.: 397,776

[22] Filed: Aug. 23, 1989

[51] Int. Cl.[5] ..... B65G 59/00

[52] U.S. Cl. ..... 221/303; 221/302; 221/312 R; 221/312 C; 206/403; 206/470; 206/634; 206/805; 206/815; 220/265; 220/338; 220/339; 220/342

[58] Field of Search ..... 221/302, 312 R, 312 C, 221/281, 61, 155, 154, 283; 206/805, 815, 233, 555, 470, 403–406, 608, 634; 229/117.18, 124; 220/265, 266, 276, 334, 338, 339, 342

[56] References Cited

U.S. PATENT DOCUMENTS

| | | | |
|---|---|---|---|
| 2,624,456 | 1/1953 | Taylor | 221/302 X |
| 3,288,329 | 11/1966 | Ketchem | 221/302 X |
| 3,651,927 | 3/1972 | Richardson et al. | 221/302 X |
| 3,876,130 | 4/1975 | Haase | 229/2.5 |
| 4,098,453 | 7/1978 | Arneson | 229/45 |
| 4,249,674 | 2/1981 | Antenore | 222/153 |
| 4,252,258 | 2/1981 | Plummer, III | 225/25 |
| 4,353,480 | 10/1982 | McFadyen | 221/63 |
| 4,462,507 | 7/1984 | Margulies | 221/63 |
| 4,580,687 | 4/1986 | Lewis | 215/237 |
| 4,637,514 | 1/1987 | Kildea et al. | 206/406 |

FOREIGN PATENT DOCUMENTS

| | | | |
|---|---|---|---|
| 3542999 | 8/1986 | Fed. Rep. of Germany | 221/302 |

*Primary Examiner*—David H. Bollinger
*Attorney, Agent, or Firm*—Weingarten, Schurgin, Gagnebin & Hayes

[57] ABSTRACT

A rubber band dispensing container for storing and dispensing rubber bands or like objects. The dispensing container comprises a unitary plastic molded body having a receptacle cover and a confronting base adjoined along a common edge by an integral hinge and further includes cooperative locking members extending outwardly from the edges of the receptacle cover and the base opposite the integral hinge for cooperative engagement therebetween when the dispensing container is in a closed configuration to securely maintain the closed position and to prevent accidental opening thereof. The dispensing container is further provided with a flap for creating a dispenser opening on the receptacle cover for inserting fingers to remove rubber bands or like objects stored therein when the dispensing container is in the closed position.

28 Claims, 3 Drawing Sheets

RUBBER BAND DISPENSER

FIELD OF THE INVENTION

This invention relates to dispensing containers and, more particularly, to a molded container for dispensing a product disposed therein when the container is in the closed position.

BACKGROUND OF THE INVENTION

A typical dispensing container for rubber bands or like objects comprises a paperboard closure having a receptacle compartment and a hinged lid wherein the lid includes an overlapping flap which is folded for placement within the receptacle compartment when the container is in the closed position. The opening and closing of such containers for storage and retrieval of objects maintained therein is inconvenient in a normal work-a-day world. As a consequence, these containers are often left in the open position, resulting in clutter and risk of spillage. Moreover, due to the inconvenience of use of such containers, the user will often simply discard the container, storing the contents in a desk drawer. This practice creates a generally messy condition and gives an unprofessional appearance to the work environment.

An additional undesirable aspect of typical containers described above lies in the fact that they are fabricated of paperboard or other nontransparent materials which prevent the consumer from viewing the contents of the container to observe size, quantity or quality of the product. As a result, the consumer will often open the container prior to purchase in order to examine the goods therein. This practice can damage the container or the contents thereof, and may potentially lead to theft of the product contained therein. More importantly, since the consumer cannot observe the product prior to making a purchasing decision, he/she may simply forego purchasing the product Another disadvantage of paperboard containers is that they have proven to be unduly expensive as compared with the contents of the container. Fabrication of such containers requires several individual stages of production, such as: cutting and scoring blank pieces of paperboard; folding the blanks into the properly shaped configuration; gluing the properly configured container; and finally filling the container. These individual stages of production increase cost of the carton and therefore increase the final cost of the items sold therein.

Prior art as disclosed in U.S. Pat. No. 4,098,453 suggests containers that can be economically produced by die forming or stamping from a single blank of paperboard. However, it is desirable to provide an economically manufactured dispensing container with the feature of dispensing a product when in the closed position. It is also desirable to provide such a dispensing container so that the contents are visible for inspection without opening the container. Yet another object of the present invention is to provide a molded plastic dispensing container in which a locking mechanism is formed as an integral part of the container for securely maintaining the dispensing container in a closed configuration.

SUMMARY OF THE INVENTION

The present invention discloses a plastic molded dispensing container for visibly storing rubber bands or like objects and dispensing objects contained therein while in the closed position. The dispensing container of the present invention comprises a unitary molded body having a receptacle cover and a base panel adjoined along a common edge by an integral hinge so that the container elements can be pivoted towards each other to create a closed relationship therebetween. The receptacle cover and base panel of the present invention further include cooperatively engageable locking members extending outwardly along the edges opposite the hinge for securely maintaining the dispensing container in a closed position to prevent accidental opening thereof.

The dispensing container of the present invention features a dispenser opening for dispensing a product when in the closed position. This feature is implemented by providing the receptacle cover of the dispensing container with a plurality of perforations defining an opening, thereby permitting the user to tear away the perforated segment of the receptacle cover to access and remove the product maintained in the dispensing container.

The present invention further provides a capability to view and display the contents of the dispensing container. Thus, the dispensing container is fabricated from a transparent plastic material allowing observation therethrough. The dispensing container further includes means, disposed in the locking member, for display of the product, as for example, at a point of purchase display. Alternatively, a slot can be disposed in the base panel to allow for insertion of a tab for mounting the dispensing container, as for example, on a paperboard backing for point of purchase display.

DESCRIPTION OF THE DRAWINGS

The invention will be more fully understood from the following detailed description taken in conjunction with the accompanying drawings, in which.

DETAILED DESCRIPTION OF THE INVENTION

Figure 1:
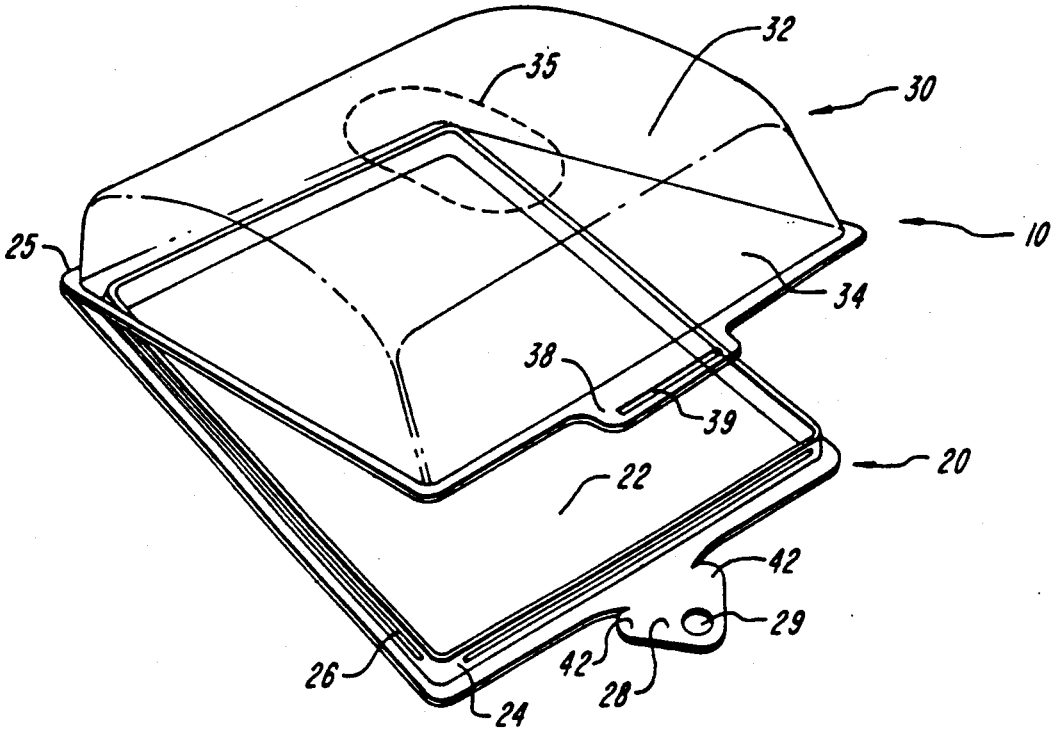
FIG. 1 is a perspective view of the rubber band dispensing container of the present invention.
Figure 3A:
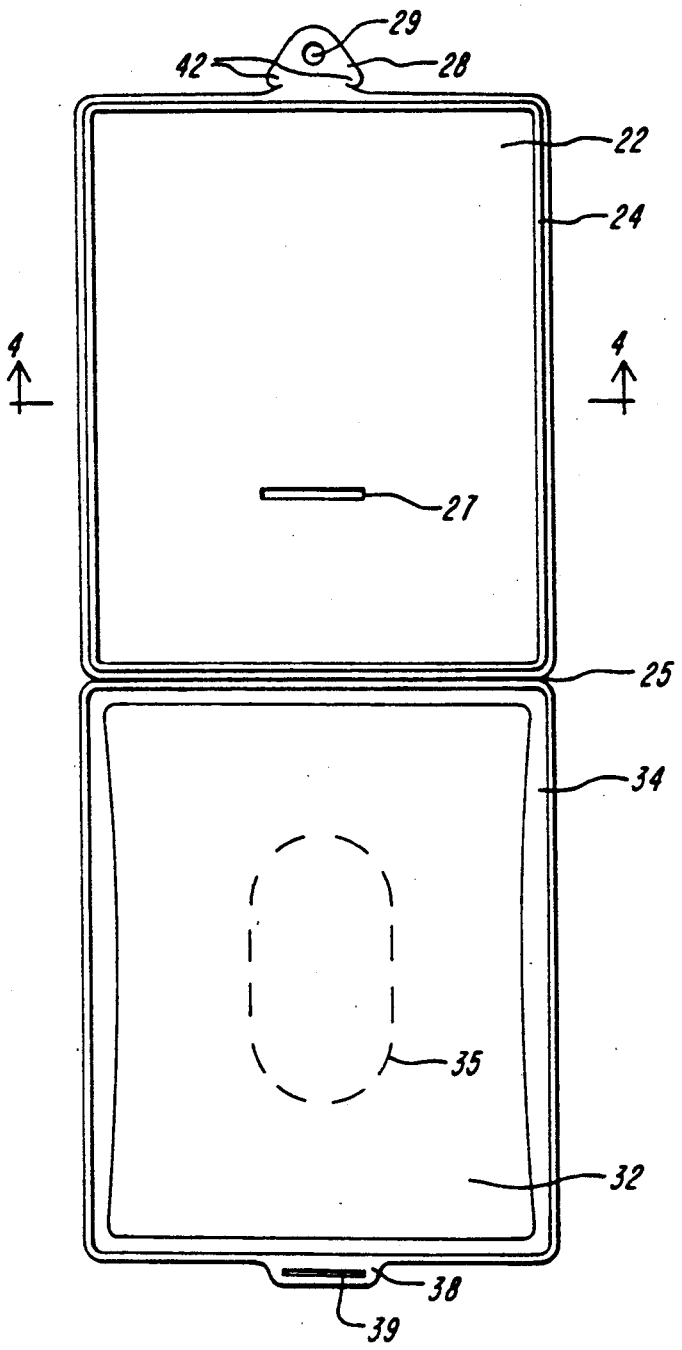
FIG. 3A is a top plan view of the container of FIG. 1.

FIG. 1 illustrates an embodiment of the rubber band dispenser, generally designated by reference numeral 10, of the present invention, comprising a base 20 and a receptacle cover 30 adjoined by hinge 25. As best shown in FIG. 1, receptacle cover 30 can be pivoted at hinge 25 for joining with base 20 to form a closed container. Hinge 25 is preferably integrally formed with base 20 and receptacle cover 30. It can further be seen from FIG. 3A that the present invention can be fashioned from a unitary blank sheet of suitable plastic material by way of thermal molding techniques well known in the art. Thus, each part of the dispensing container is simultaneously formed in a common mold wherein each part is integral with one another.

Figure 4:
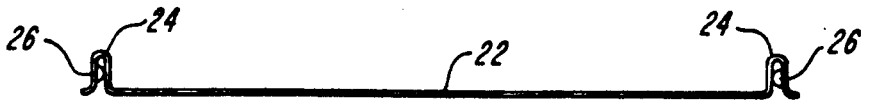
FIG. 4 is a cross sectional view of the lid of the present invention taken across section line A—A of FIG. 3A.
Figure 3C:
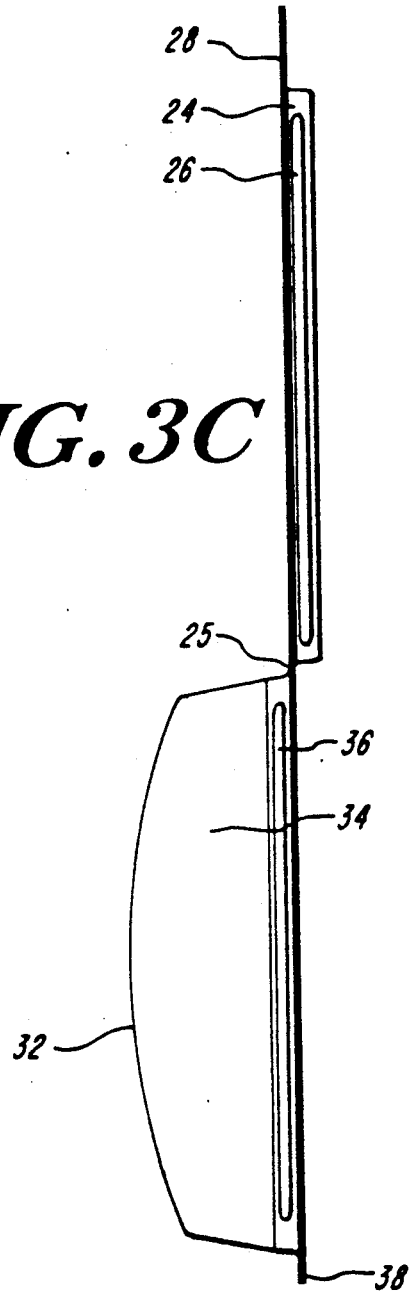
FIG. 3C is a side elevational view of the container of FIG. 1.
Figure 3B:
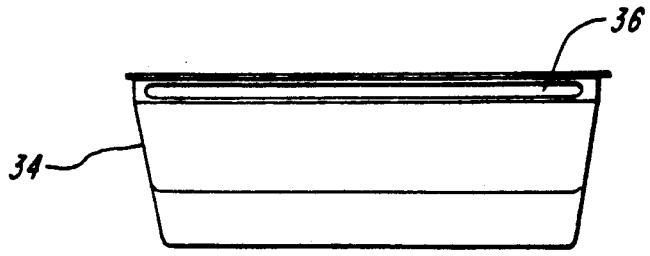
FIG. 3B is a front elevational view of the container of FIG. 1.

Base 20 comprises a substantially flat panel 22 so that the dispenser can be positioned for use on a desk surface wherein said flat panel 22 is circumscribed by a peripheral ridge 24 protruding substantially perpendicular from panel 22 as shown in the cross sectional view of FIG. 4. Peripheral ridge 24 extends around the perimeter of the base 20 for engagement with the side walls of the receptacle cover 30 when the dispensing container 10 is in a closed configuration. Alternatively, ridge 24 can be positioned at selective positions along the perimeter sufficient to prevent gaps through which rubber bands or articles could slip through.

The ridge 24 further comprises a latching element 26 preferably implemented by either a projecting lip or a recessed groove formed substantially perpendicular to the outside surface of the ridge 24 for providing either an interfitting or an overlapping relationship with a similar channel formed on the receptacle cover 30, as will be described. The base 20 further comprises a locking member 28 extending outwardly from the edge of the base 20 opposite the hinge 25 preferably having the shape of a tab for receptive engagement with a cooperative locking member 38 on the receptacle cover 30, as will be described.

Figure 2:
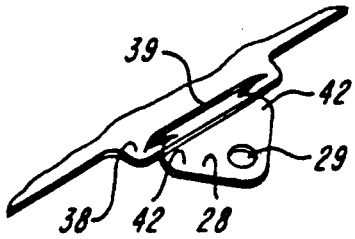
FIG. 2 is an enlarged partial view of the cooperative locking members of FIG. 1.

Receptacle cover 30 comprises a cover panel 32 of generally rounded or bowed configuration and substantially flat sidewalls 34 forming a receiving chamber for containment of rubber bands or like articles disposed therein. The configuration shown provides maximum volume, but other configurations which are generally chamber shaped may be provided. One side wall 34 is joined to the base 20 via an integral hinge 25. The free edges of the side walls 34 further comprise latching elements 36 preferably implemented by either a projecting lip or a recessed groove extending substantially perpendicular from the side walls 34 for cooperative engagement with the latching element 26 on base 20. The receptacle cover 30 further includes a locking member 38 projecting outwardly from the free edge of the side wall 34 opposite the hinge 25 comprising a transverse slot 39 for receiving the locking member 28 of the base 20, as seen in FIG. 2. Thus, the locking members 28, 38 provide a mechanism for creating a securely locked relationship between the base 20 and the receptacle cover 30 when the dispensing container is in the closed configuration. Locking member 28 may include oversized ears 42 for abutting locking member 38 adjacent to slot 39, and may further have a generally pointed tip for ease of insertion into slot 39.

Receptacle cover 30 is further provided with a dispenser opening 35 so that articles contained within the dispensing container 10 can be accessed therefrom when the container is in the closed position. The opening 35 preferably is sized to allow the insertion of two or three fingers, for example, the thumb and forefinger, for easily removing articles contained within the container. As shown in FIG. 1, the opening 35 may be implemented by creating a series of perforations defining the shape of the dispenser opening 35 in the cover panel 32 such that the user manually creates the dispenser opening 35 by tearing away the perforated portion of the cover panel 32. Alternatively, a hole in the shape of the dispenser opening 35 can be disposed on the cover panel with a strip of tear-away material such as tape or foil applied to the dispenser opening 35 to create a removable seal over the dispenser opening 35.

In accordance with the present invention, the dispensing container is adapted for use by placing a quantity of rubber bands or other like objects into the receiving chamber of the receptacle cover 30 and subsequently joining the base 20 therewith, such that the peripheral ridge 24 of the base 20 protrudes into the receiving chamber of the receptacle cover 30 and abuts the sidewalls 34 thereof. The latching element 26 of the peripheral ridge 24 mates with the latching elements 36 of the sidewalls 34. The closed container is made additionally secure from accidental opening by inserting the locking member 28 of the base 20 into the transverse slit 39 of the locking member 38. In order to access the contents of the container thus formed, the user tears away a portion of the cover panel 34 to form a dispenser opening 35, thereby creating the dispensing container 10 of the present invention. Both the locking members 28, 38 and the latching elements 26, 36 can be demated so that the user can refill the dispenser.

The dispensing container preferably provides transparent packaging and display of the articles contained therein. Thus, by providing the locking member 28 with a through hole 29, a hook or other hanging device can be inserted therethrough for suspending and displaying the dispensing container therefrom, for example, at a point of purchase display. Alternatively, the base 20 can be provided with a slot 27, a shown in FIG. 3A, such that the dispensing container can be attached to a paperboard panel or the like for display therefrom. These alternative display means can be used advantageously to hang the container for dispensing articles therefrom.

A variety of modifications and variations of the present method and apparatus are possible in light of the teaching set forth above. Therefore, it is to be understood that the present invention is to be viewed as embracing each and every novel feature and novel combination of features present in, or possessed by, the invention disclosed herein, limited solely by the scope and spirit of the appended claims.

What is claimed is:

1. A dispensing container for dispensing articles contained therein when in a closed configuration, said dispensing container comprising:

a base having a flat panel and a slot for attaching said dispensing container to a display means;

a receptacle cover having a cover panel and a plurality of side walls forming a chamber for receiving articles;

a hinge adjoining said base and said receptacle cover along a common edge forming a pivot axis therebetween;

means, including at least one ridge protruding from the perimeter of said base, said ridge being cooperative with said side walls for securing said receptacle cover to said base; and means for accessing the articles container within said dispensing container with said receptacle cover secured to said base in a closed configuration.

2. The dispensing container of claim 1, wherein said hinge is integral with said base and said receptacle cover.

3. The dispensing container of claim 1, wherein said dispensing container is of unitary construction.

4. The dispensing container of claim 1, wherein said dispensing container is fabricated from a generally transparent material.

5. A dispensing container, for dispensing articles container therein when in a closed configuration, said dispensing container comprising:

a base having a flat panel;

a receptacle cover having a cover panel and a plurality of side walls forming a chamber for receiving articles;

a hinge adjoining said base and said receptacle cover along a common edge forming a pivot axis therebetween;

means, including at least one ridge protruding from the perimeter of said base, said ridge being cooperative with said side walls, for securing said receptacle cover to said base, said means for securing said base to said receptacle cover further including:

a first latching channel disposed along the outside surface of said at least one ridge; and a second latching channel disposed along the free edges of said side walls for a receptive engagement with said first latching channel; and means for accessing the articles container within said dispensing container with said receptacle cover secured to said base in a closed configuration.

6. The dispensing container of claim 5, wherein:

said first latching channel forms a recessed groove in the outer surface of said ridge; and said second latching channel forms a projecting lip on said sidewalls for fitting within said first latching channel when said dispensing container is in a closed configuration.

7. The dispensing container of claim 5, wherein:

said first latching channel forms a projecting lip on the outer surface of said ridge; and said second latching channel forms a recessed groove in said sidewalls such that said first latching channel interfits within said second latching channel when said dispensing container is in a closed configuration.

8. The dispensing container of claim 5, wherein:

said first latching channel forms a projecting lip on the outer surface of said ridge; and said second latching channel forms a projecting lip on said sidewalls such that said first latching channel overlaps said second latching channel when said dispensing container is in a closed configuration.

9. The dispensing container of claim 5 further including a second means for securing said base to said receptacle cover, wherein:

said base further includes a first locking member extending outwardly from the edge thereof opposite said hinge; and said receptacle cover further includes a second locking member extending outwardly from the free edge of the sidewall thereof opposite said hinge for receptive engagement with said first locking member.

10. The dispensing container of claim 9, wherein:

said first locking member comprises a tab; and said second locking member comprises a transverse slot for receiving said tab.

11. The dispensing container of claim 10, wherein said tab includes a generally pointed tip for ease of insertion into said transverse slot.

12. The dispensing container of claim 10, wherein:

said tab includes at least one ear abutting said edge of said base opposite said hinge and extending beyond at least one end of said transverse slot for locking said receptacle cover to said base when said dispensing container is in a closed configuration.

13. The dispensing container of claim 10, wherein:

said tab further includes a through hole for attaching said dispensing container to a display means.

14. A dispensing container, for dispensing articles contained therein when in a closed configuration, said dispensing container comprising:

a base having a flat panel;

a receptacle cover having a cover panel and a plurality of side walls forming a chamber for receiving articles;

a hinge adjoining said base and said receptacle cover along a common edge forming a pivot axis therebetween;

means, including at least one ridge protruding from the perimeter of said base, said ridge being cooperative with said side walls for securing said receptacle cover to said base; and means for accessing the articles container within said dispensing container with said receptacle cover secured to said base in a closed configuration, said means for accessing the articles contained therein including means for forming a dispensing opening sized for receiving fingers for grasping the articles container therein.

15. The dispensing container of claim 14, wherein:

said means for forming said dispenser opening includes a plurality of perforations delimiting said dispenser opening.

16. The dispensing container of claim 14, wherein:

said means for forming said dispenser opening includes a hole in said receptacle cover and a removable strip of material positioned to cover the hole.

17. A dispensing container, for dispensing articles container therein when in a closed configuration, said dispensing container comprising:

a base having a flat panel;

a receptacle cover having a cover panel and a plurality of side walls forming a chamber for receiving articles;

a hinge adjoining said base and said receptacle cover along a common edge forming a pivot axis therebetween;

means, including at least one ridge protruding from the perimeter of said base, said ridge being cooperative with said side walls for securing said receptacle cover to said base; and means for accessing the articles container within said dispensing container with said receptacle cover secured to said base in a closed configuration, said means for accessing the articles contained therein including a dispenser opening sized for receiving fingers for grasping the articles container therein.

18. A dispensing container for dispensing articles contained therein when in a closed configuration, said dispensing container comprising:

a base having a flat panel;

a receptacle cover having a cover panel and a plurality of side walls forming a chamber for receiving articles;

a hinge adjoining said base and said receptacle cover along a common edge forming a pivot axis therebetween;

means for securing said receptacle cover to said base including:

a first locking member extending outwardly from an edge of said base opposite said hinge, said first locking member comprising a tab, said tab further including a through hole for attaching said dispensing container to a display means; and a second locking member extending outwardly from a free edge of the side wall opposite said hinge, said second locking member having a further through hole for receptive engagement of said first locking member, said through hole comprising a transverse slot for receiving said tab; and means for accessing the articles container within said dispensing container with said receptacle cover secured to said base in a closed configuration.

19. The dispensing container of claim 18, wherein said hinge is integral with said base and said receptacle cover.

20. The dispensing container of claim 18, wherein said dispensing container has a unitary construction.

21. The dispensing container of claim 18, wherein said dispensing container is fabricated from a generally transparent material.

22. The dispensing container of claim 18, wherein:

said base further includes a slot for attaching said dispensing container to a display means.

23. The dispensing container of claim 18, wherein:

said tab includes a generally pointed tip for ease of insertion into said transverse slot.

24. The dispensing container of claim 18, wherein:

said tab includes at least one ear abutting said edge of said base opposite said hinge and extending beyond at least one end of said transverse slot for locking said receptacle cover to said base when said dispensing container is in a closed configuration.

25. The dispensing container of claim 18, wherein:

said means for accessing the articles contained therein includes means for forming a dispenser opening sized for receiving fingers for grasping the articles contained therein.

26. The dispensing container of claim 25, wherein:

said means for forming said dispenser opening includes a plurality of perforations delimiting said dispenser opening.

27. The dispensing container of claim 25, wherein:

said means for forming said dispenser opening includes a hole in said receptacle cover and a removable strip of material positioned to cover the hole.

28. The dispensing container of claim 18, wherein:

said means for accessing the articles contained therein includes a dispenser opening sized for receiving fingers for grasping the articles contained therein.

* * * * *

UNITED STATES PATENT AND TRADEMARK OFFICE

CERTIFICATE OF CORRECTION

PATENT NO. : 5,037,000

DATED : August 6, 1991

INVENTOR(S) : Robert Selame

It is certified that error appears in the above-identified patent and that said Letters Patent is hereby corrected as shown below:

Column 4, line 58, "container" should read --contained--.

Column 5, line 2, "container" should read --contained--.

Column 5, line 21, "container" should read --contained--.

Column 6, line 20, "container" should read --contained--.

Column 6, line 26, "container" should read --contained--.

Column 6, line 49, "container" should read --contained--.

Column 6, line 54, "container" should read --contained--.

Column 7, line 11, "container" should read --contained--.

Signed and Sealed this

Eighth Day of June, 1993

Michael K. Kirk

*Attest:*

MICHAEL K. KIRK

*Attesting Officer*

*Acting Commissioner of Patents and Trademarks*